US007481046B2

(12) United States Patent
Goralski, Jr. et al.

(10) Patent No.: US 7,481,046 B2
(45) Date of Patent: Jan. 27, 2009

(54) METHOD OF DESULFATING A $NO_X$ STORAGE AND CONVERSION DEVICE

(75) Inventors: Christian T. Goralski, Jr., St. Paul, MN (US); Joseph R. Theis, Rockwood, MI (US); Justin Ura, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 651 days.

(21) Appl. No.: 11/069,526

(22) Filed: Feb. 28, 2005

(65) Prior Publication Data

US 2006/0191257 A1 Aug. 31, 2006

(51) Int. Cl.
*F01N 3/00* (2006.01)
*F01N 3/10* (2006.01)

(52) U.S. Cl. ..... 60/295; 60/285; 60/286; 60/301

(58) Field of Classification Search ..... 60/285, 60/286, 295, 301
See application file for complete search history.

(56) References Cited

U.S. PATENT DOCUMENTS 6,199,373 B1 * 3/2001 Hepburn et al. ..... 60/274
6,327,849 B1 * 12/2001 Sugiura et al. ..... 60/277
6,378,297 B1 * 4/2002 Ito et al. ..... 60/284
6,530,216 B2 3/2003 Pott
6,574,955 B2 6/2003 Schroder et al.
6,637,189 B1 * 10/2003 Boegner et al. ..... 60/274
6,637,198 B2 * 10/2003 Hertzberg ..... 60/295
6,843,052 B2 * 1/2005 Hertzberg et al. ..... 60/274
6,922,988 B2 * 8/2005 Yamaguchi et al. ..... 60/286
7,284,368 B2 * 10/2007 Surnilla et al. ..... 60/285
2003/0131591 A1 7/2003 Pott et al.
2004/0123585 A1 7/2004 Yamaguchi et al.

* cited by examiner

*Primary Examiner*—Thomas Denion
*Assistant Examiner*—Loren Edwards
(74) *Attorney, Agent, or Firm*—Allan J. Lippa; Alleman Hall McCoy Russell & Tuttle LLP

(57) ABSTRACT

A method of desulfating a catalytic $NO_x$ storage and conversion device is disclosed, wherein the method includes determining an amount of sulfur stored in the catalytic $NO_x$ storage and conversion device; determining an interval for exposing the catalytic $NO_x$ storage and conversion device to a rich exhaust stream based upon the determined amount of sulfur stored, wherein the interval is longer for lower amounts of sulfur stored and shorter for higher amounts of sulfur stored; and exposing the catalytic $NO_x$ storage and conversion device to the rich exhaust stream for the determined interval.

26 Claims, 6 Drawing Sheets

METHOD OF DESULFATING A $NO_X$ STORAGE AND CONVERSION DEVICE

FIELD

The present application relates to the field of automotive emission control systems and methods.

BACKGROUND AND SUMMARY

Lean-burning engines, or engines that run on an air/fuel mixture with a stoichiometrically greater amount of air than fuel, can offer improved fuel economy relative to engines configured to run on stoichiometric air/fuel mixtures.

However, lean-burning engines also may pose various disadvantages. For example, burning a lean air/fuel mixture may decrease the reduction of nitrogen oxides (collectively referred to as "$NO_x$") in a conventional three-way catalytic converter.

Various mechanisms have been developed to reduce $NO_x$ emissions in lean-burning engines. One mechanism is a $NO_x$ trap. The $NO_x$ trap is a catalytic device typically positioned downstream of a catalytic converter in an emissions system, and is configured to retain $NO_x$ when the engine is running a lean air/fuel mixture and then release and reduce the $NO_x$ when the engine runs a more rich air/fuel mixture.

A typical $NO_x$ trap includes one or more precious metals, and an alkali or alkaline metal oxide to which nitrogen oxides adsorb as nitrates when the engine is running a lean air/fuel mixture. The engine can then be configured to periodically run a richer air/fuel mixture. The nitrates decompose under rich conditions, releasing the $NO_x$. This reacts with the carbon monoxide, hydrogen gas and various hydrocarbons in the exhaust over the precious metal to form $N_2$, thereby decreasing the $NO_x$ emissions and regenerating the trap.

The use of a $NO_x$ trap can substantially reduce $NO_x$ emissions from a lean-burning engine. However, $SO_2$ produced by the combustion of sulfur in fuel can form sulfates, which can poison the $NO_x$ storage sites and lower the $NO_x$ storage capacity of the trap.

The $NO_x$ storage capacity of the trap may be recovered by operating the trap for several minutes at a high temperature (for example, around 700° C.) under rich conditions. However, this process can result in the formation and emission of hydrogen sulfide, which has an unpleasant odor. The emission of hydrogen sulfide may be suppressed by alternating between lean and rich conditions while holding the $NO_x$ trap at desulfation conditions. However, this may slow desulfation significantly.

German Published Patent Application No. DE 198 49 082 A1 teaches a multistage desulfation process. In the first stage, a $NO_x$ trap is exposed to slightly rich conditions (air/fuel ratio=0.98) and a relatively low desulfation temperature for a first period of time. In the second stage, the air/fuel ratio is modulated about the initial value. As the second stage progresses, the amplitude of the modulation is increased, the temperature is increased, and the frequency and midpoint of the modulation are decreased. This method may decrease the time required for desulfation relative to fixed amplitude/frequency modulation schemes. However, this method may still cause the production of excess hydrogen sulfide, and/or take more time than necessary to complete desulfation, as it does not take into account an amount of hydrogen sulfide in a trap at any instant during the desulfation process.

The inventors herein have recognized that the formation and emission of hydrogen sulfide during desulfation may be more efficiently addressed by utilizing a method of desulfating a catalytic $NO_x$ storage and conversion device that includes determining an amount of sulfur stored in the catalytic $NO_x$ storage and conversion device; determining an interval for exposing the catalytic $NO_x$ storage and conversion device to a rich exhaust stream based upon the determined amount of sulfur stored, wherein the interval is longer for lower amounts of sulfur stored and shorter for higher amounts of sulfur stored; and exposing the catalytic $NO_x$ storage and conversion device to the rich exhaust stream for the determined interval.

DETAILED DESCRIPTION OF THE DEPICTED EMBODIMENTS

Figure 1:
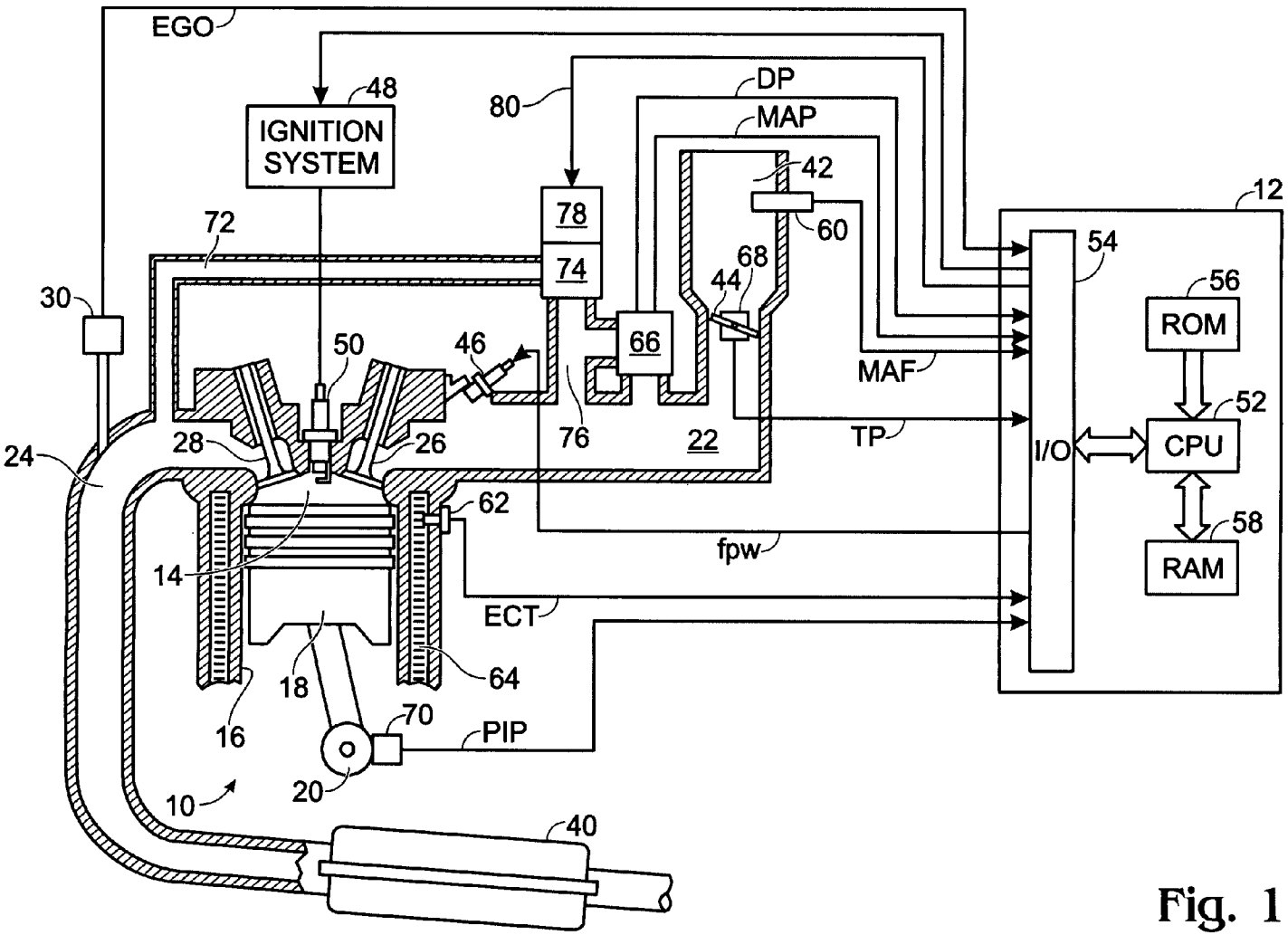
FIG. 1 is a schematic depiction of an embodiment of an internal combustion engine.

FIG. 1 shows a schematic depiction of an internal combustion engine 10. Engine 10 typically includes a plurality of cylinders, one of which is shown in FIG. 1, and is controlled by an electronic engine controller 12. Engine 10 includes a combustion chamber 14 and cylinder walls 16 with a piston 18 positioned therein and connected to a crankshaft 20. Combustion chamber 14 communicates with an intake manifold 22 and an exhaust manifold 24 via a respective intake valve 26 and exhaust valve 28. An exhaust gas oxygen sensor 30 is coupled to exhaust manifold 24 of engine 10, and an emissions treatment stage 40 is coupled to the exhaust manifold downstream of the exhaust gas oxygen sensor. The depicted engine may be configured for use in an automobile, for example, a passenger vehicle or a utility vehicle.

Intake manifold 22 communicates with a throttle body 42 via a throttle plate 44. Intake manifold 22 is also shown having a fuel injector 46 coupled thereto for delivering fuel in proportion to the pulse width of signal (fpw) from controller 12. Fuel is delivered to fuel injector 46 by a conventional fuel system (not shown) including a fuel tank, fuel pump, and fuel rail (not shown). Engine 10 further includes a conventional distributorless ignition system 48 to provide an ignition spark to combustion chamber 30 via a spark plug 50 in response to controller 12. In the embodiment described herein, controller 12 is a conventional microcomputer including: a microprocessor unit 52, input/output ports 54, an electronic memory chip 56, which is an electronically programmable memory in this particular example, a random access memory 58, and a conventional data bus.

Controller 12 receives various signals from sensors coupled to engine 10, in addition to those signals previously discussed, including: measurements of inducted mass air flow (MAF) from a mass air flow sensor 60 coupled to throttle body 42; engine coolant temperature (ECT) from a temperature sensor 62 coupled to cooling jacket 64; a measurement of manifold pressure (MAP) from a manifold absolute pressure sensor 66 coupled to intake manifold 22; a measurement of throttle position (TP) from a throttle position sensor 68 coupled to throttle plate 44; and a profile ignition pickup signal (PIP) from a Hall effect sensor 118 coupled to crankshaft 40 indicating an engine speed (N).

Exhaust gas is delivered to intake manifold 22 by a conventional EGR tube 72 communicating with exhaust manifold 24, EGR valve assembly 74, and EGR orifice 76. Alternatively, tube 72 could be an internally routed passage in the engine that communicates between exhaust manifold 24 and intake manifold 22.

Manifold absolute pressure sensor 66 communicates with EGR tube 72 between valve assembly 74 and orifice 76. Manifold absolute pressure sensor 66 also communicates with intake manifold 22. Stated another way, exhaust gas travels from exhaust manifold 24 first through EGR valve assembly 74, then through EGR orifice 76, to intake manifold 22. EGR valve assembly 74 can then be said to be located upstream of orifice 76.

Manifold absolute pressure sensor 66 provides a measurement of manifold pressure (MAP) and pressure drop across orifice 74 (DP) to controller 12. Signals MAP and DP are then used to calculate EGR flow. EGR valve assembly 74 has a valve position (not shown) for controlling a variable area restriction in EGR tube 72, which thereby controls EGR flow. EGR valve assembly 74 can either minimally restrict EGR flow through tube 72 or completely restrict EGR flow through tube 72. Vacuum regulator 78 is coupled to EGR valve assembly 73. Vacuum regulator 78 receives actuation signal on line 80 from controller 12 for controlling valve position of EGR valve assembly 74. In a preferred embodiment, EGR valve assembly 74 is a vacuum actuated valve. However, as is obvious to those skilled in the art, any type of flow control valve may be used, such as, for example, an electrical solenoid powered valve or a stepper motor powered valve. Note that alternative EGR systems can also be used, such as those having an orifice upstream of the EGR control valve. Further, systems utilizing a stepper motor valve without an orifice can also be used.

Figure 2:
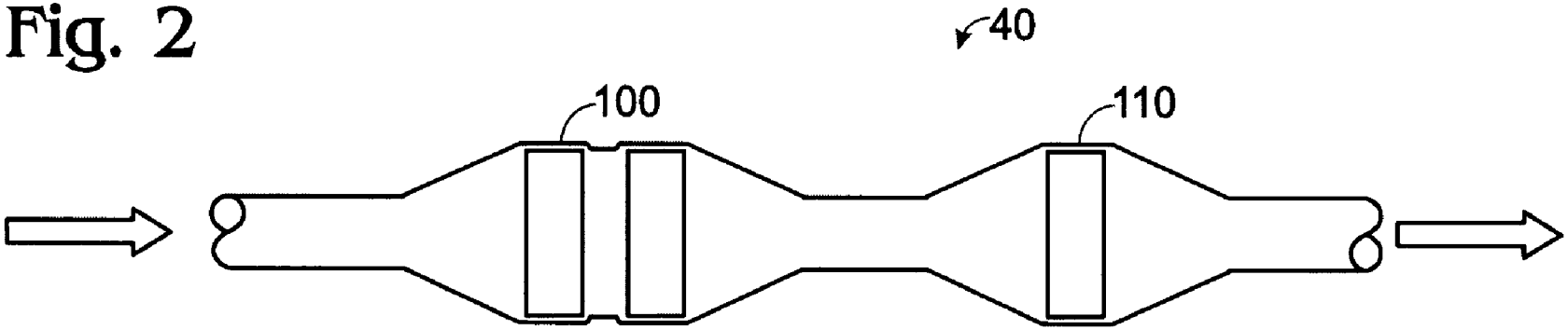
FIG. 2 is a schematic depiction of an embodiment of an emissions treatment system for an internal combustion engine.

FIG. 2 shows a schematic depiction of an exemplary embodiment of emissions stage 40. Emissions stage 40 includes a three-way catalytic converter 100, and a $NO_x$ trap 110 positioned downstream of three-way catalytic converter 100. $NO_x$ trap 110 typically includes one or more precious metals, such as platinum, rhodium, and/or palladium, to convert $NO_x$ in an emissions stream to $NO_2$. $NO_x$ trap 110 also typically includes an alkali or alkaline metal oxide or oxides, such as barium oxide, to which $NO_2$ adsorbs as a nitrate when the engine is running a lean air/fuel mixture. The engine can then be configured to periodically run a richer air/fuel mixture. The nitrates decompose under these conditions, releasing the $NO_x$ which then reacts with the carbon monoxide, hydrogen gas and various hydrocarbons in the exhaust over the precious metal to form $N_2$, thus decreasing the $NO_x$ emissions and regenerating the trap 110.

However, the combustion of sulfur in fuel produces $SO_2$ in the exhaust. Under lean conditions, this $SO_2$ is oxidized over the precious metal in $NO_x$ trap 110 or three-way catalyst 100 to form $SO_3$, which can then react with the alkaline earth or alkali metal oxides in $NO_x$ trap 110 to form sulfates. These sulfates can poison the $NO_x$ storage sites and lower the $NO_x$ storage capacity of the trap 110.

As mentioned above, the sulfates can be removed from $NO_x$ trap 110 by heating the trap for several minutes at a temperature between approximately 600 C and 800 C and operating the engine under rich conditions. When sulfates are purged from a $NO_x$ trap in this manner, they are mostly converted into sulfur dioxide ($SO_2$), hydrogen sulfide ($H_2S$), and carbonyl sulfide (COS) in the exhaust. Of these three compounds, hydrogen sulfide is of the most concern because of its unpleasant odor. It is desirable for the concentration of hydrogen sulfide in the exhaust not to exceed approximately 20 ppm. When a trap is operated continuously rich at desulfation conditions, however, the concentration of hydrogen sulfide can reach concentrations of greater than 500 ppm.

Modulating the air/fuel ratio between rich and lean during desulfation may reduce the amount of hydrogen sulfide produced, but also may require more time to complete desulfation. The multistage desulfation process taught by German Published Patent Application No. DE 198 49 082 A1 may offer improved desulfation performance over modulation schemes in which the modulation frequency is held constant, but still may result in the formation of excess hydrogen sulfide, and/or inefficient desulfation.

To overcome such problems, the duration of each rich cycle in a desulfation process may be selected based upon an instantaneous amount of sulfur determined to be present in the trap at the beginning of that rich cycle. As described in more detail below, the peak hydrogen sulfide level emitted during a rich desulfation cycle is a function of the instantaneous amount of sulfur stored in the trap. Higher amounts of stored sulfur generally result in higher peak hydrogen sulfide productions during a rich cycle for any specific temperature. Therefore, a $NO_x$ trap with low amounts of stored sulfur can make use of longer rich times and shorter overall desulfation processes without producing overly high peak hydrogen sulfide levels, while large amounts of stored sulfur may require shorter rich times and longer overall desulfation processes to maintain low hydrogen sulfide levels. Furthermore, by actually determining an amount of sulfur stored in $NO_x$ trap 110 and then selecting a predetermined rich cycle interval based upon the determined amount of sulfur, the rich cycle may be optimized for each rich/lean desulfation cycle during a desulfation process. In this manner, both excess hydrogen sulfide produced by using too long a rich cycle as well as slow desulfation processes caused by too short a rich time may be simultaneously avoided.

Figure 3:
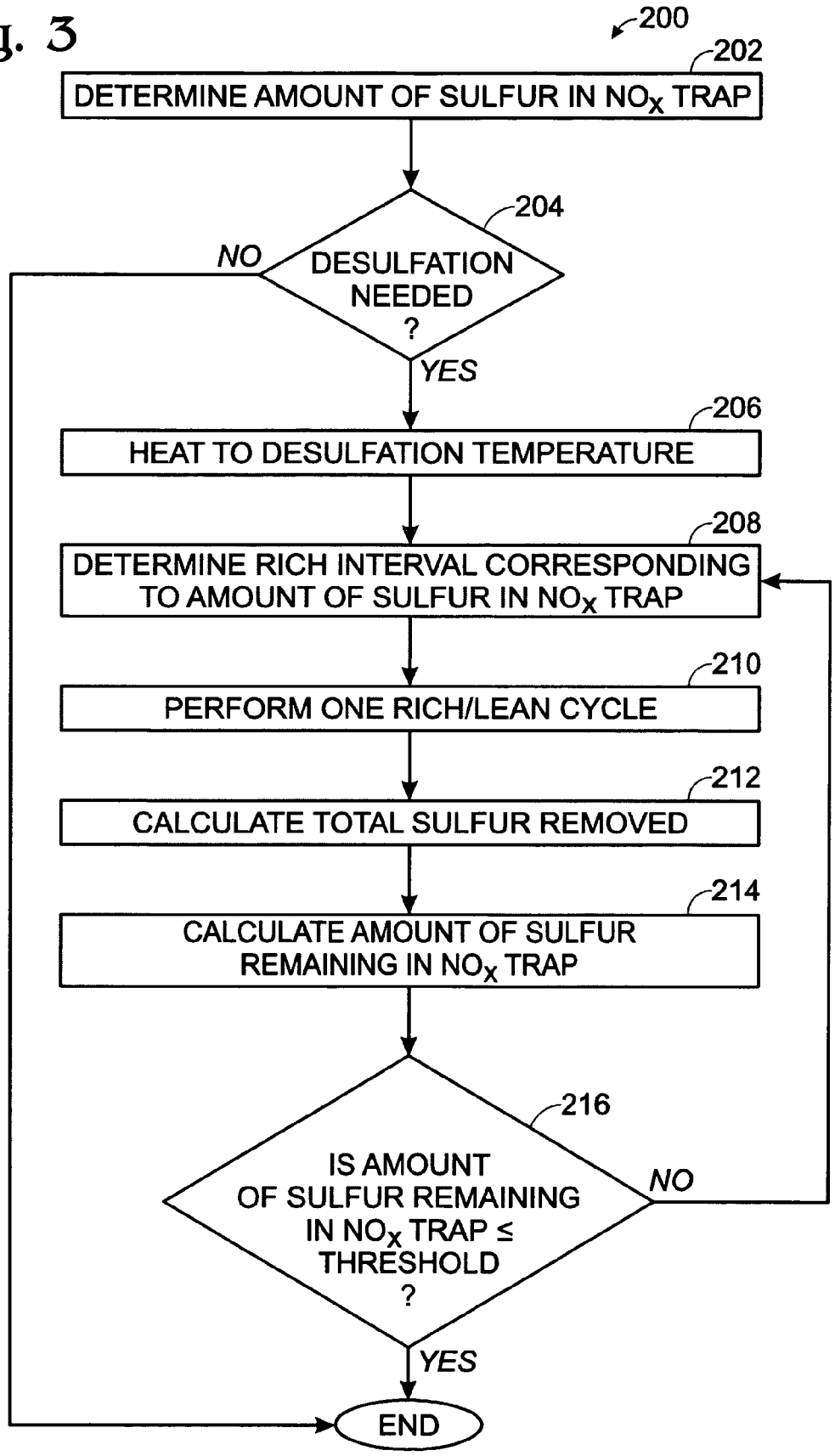
FIG. 3 is a flow diagram of an embodiment of a method for desulfating a $NO_x$ trap.

FIG. 3 shows, generally at 200, one exemplary embodiment of a method of desulfating a $NO_x$ trap that may provide for more rapid desulfation with less hydrogen sulfide production than known methods. The various steps of method 200 are typically performed or controlled by controller 12, and instructions executable by processor 52 to perform method 200 may be stored in memory 56 and/or memory 58.

Method 200 includes determining, at 202, an amount of sulfur in $NO_x$ trap 110, and then determining, at 204, whether desulfation is needed. For example, to make this determination, the amount of sulfur determined to be stored in $NO_x$ trap 110 may be compared to a threshold amount of stored sulfur (which may be referred to as a "begin-desulfation" threshold) . Alternatively, any other suitable method may be used to determine whether desulfation is needed.

If desulfation is determined not to be needed, method 200 is terminated, and can be performed either immediately, or after waiting any suitable interval. On the other hand, if it is determined at 204 that desulfation is needed, $NO_x$ trap 110 is next heated to a desired desulfation temperature at 206. Then, before exposing $NO_x$ trap 110 to rich exhaust, a rich interval corresponding to the amount of stored sulfur is determined, at 208. Next, $NO_x$ trap 110 is exposed to one rich/lean cycle, at 210. This includes first exposing $NO_x$ trap 110 to a rich exhaust stream for the determined interval, and then exposing $NO_x$ trap 110 to a lean exhaust stream. The lean exhaust stream interval may also be based upon the determined amount of sulfur stored, or may be a fixed and/or preselected interval. Determining an amount of sulfur in the trap and then selecting the duration of the rich cycle based upon the determined amount of stored sulfur allows a rich cycle duration to be selected that avoids production of excess hydrogen sulfide, yet is also not unnecessarily short.

After performing the rich/lean cycle at 210, the total amount of sulfur removed from $NO_x$ trap 110 by the rich/lean cycle is calculated at 212, and then the total amount of sulfur remaining in $NO_x$ trap 110 is calculated at 214. Next, the total amount of sulfur remaining in $NO_x$ trap 110 is compared, at 216, to a threshold (which may be referred to as an "end-desulfation" threshold). If the total amount of sulfur remaining in $NO_x$ trap 110 is not equal to or less than the end-desulfation threshold, then another rich cycle interval is determined at 208, and another rich/lean cycle is performed (using the newly-determined rich cycle interval). It will be appreciated that the rich cycle interval may base upon time duration, a number of engine rotations, or any other suitable measure. Method 200 continues to cycle in this manner until it is determined at 214 that the amount of sulfur remaining in $NO_x$ trap 110 is equal to or below the end-desulfation threshold. At this point, method 200 ends until a new begin-desulfation threshold of sulfur stored in $NO_x$ trap 110 is reached.

The determination of the amount of sulfur stored in $NO_x$ trap 110 may be performed in any suitable manner. For example, an amount of sulfur dioxide produced by the combustion of fuel in the engine can be determined by knowing or estimating an amount of sulfur in the fuel, and then integrating the amount of sulfur burned and stored in $NO_x$ trap 100 by assuming 100% (or any other suitable fraction) conversion and storage. The amount of sulfur determined to be produced by the combustion of fuel then may be added to an amount of sulfur remaining in $NO_x$ trap 110 after completion of the last desulfation process was completed to give a total amount of sulfur.

Alternatively, diagnostic methods utilizing HEGO, UEGO and/or $NO_x$ sensors in the engine may be utilized. For example, a delay time between a front UEGO and rear UEGO during a rich to lean transition may be measured. Such a delay results from the uptake of $O_2$ by the oxygen storage components in $NO_x$ trap 110. Sulfur poisoning degrades these oxygen storage components, so this delay time will decrease as the catalyst is poisoned. The delay time and a calibration curve between the amount of sulfur and this delay time could be used to estimate the amount of sulfur in $NO_x$ trap 110. Likewise, a delay time between front and rear UEGO sensors during the lean-to-rich transition due to a combination of oxygen release from the OSC materials and the release of $NO_x$ from the $NO_x$ storage materials may be measured. Again, this delay time and a calibration curve between sulfur uptake and this lean-to-rich delay time may be used to estimate the amount of sulfur in the trap. These methods may be used to estimate the amount of sulfur in the trap to determine when a desulfation is needed. Alternately, the methods could be performed during the desulfation to estimate the amount of sulfur remaining in the trap after each rich/lean cycle.

Likewise, any suitable begin-desulfation threshold may be selected for determining whether desulfation is needed. Examples of suitable begin-desulfation thresholds include, but are not limited to, thresholds in the range of between approximately 0.1 to 0.5 g/liter of sulfur. Furthermore, $NO_x$ trap 110 may be heated to any suitable temperature for desulfation. Examples include, but are not limited to, temperatures of between approximately 600° C. and 800° C. The use of temperatures on the higher end of this range may encourage more rapid desulfation. Furthermore, method 200 does not require any initial period of lower temperature desulfation, as taught in DE 198 49 082 A1. This may further contribute to improvements in efficiency relative to the methods taught in DE 198 49 082 A1.

The rich interval to which $NO_x$ trap 110 is exposed may be determined in any suitable manner. In one exemplary embodiment, controller 12 may include a look-up table correlating different rich intervals with different amounts of sulfur stored, different rich air/fuel ratios, and/or different desulfation temperatures. Such a look-up table may be based on values that are determined experimentally and then loaded into memory 56. Alternatively, any other suitable method may be used to determine the rich interval.

The total sulfur removed by a single rich cycle and a total amount of sulfur remaining in $NO_x$ trap 110 after performing the rich cycle likewise may be calculated in any suitable manner. In one exemplary embodiment, the amount of sulfur removed by a rich cycle is determined via a correlation based upon the current sulfur stored in $NO_x$ trap 110, the rich time of the cycle, and the temperature of the desulfation. Next, the amount of sulfur remaining on $NO_x$ trap 110 may be calculated by subtracting the amount of sulfur removed by the rich cycle from the total amount of sulfur stored on $NO_x$ trap 110 before the rich cycle.

The end-desulfation threshold to which the amount of sulfur remaining on $NO_x$ trap 110 after each rich cycle is compared may have any suitable value. Suitable end-desulfation thresholds include, but are not limited to, thresholds in the range of approximately 0 to 0.4 g/liter.

Figure 4:
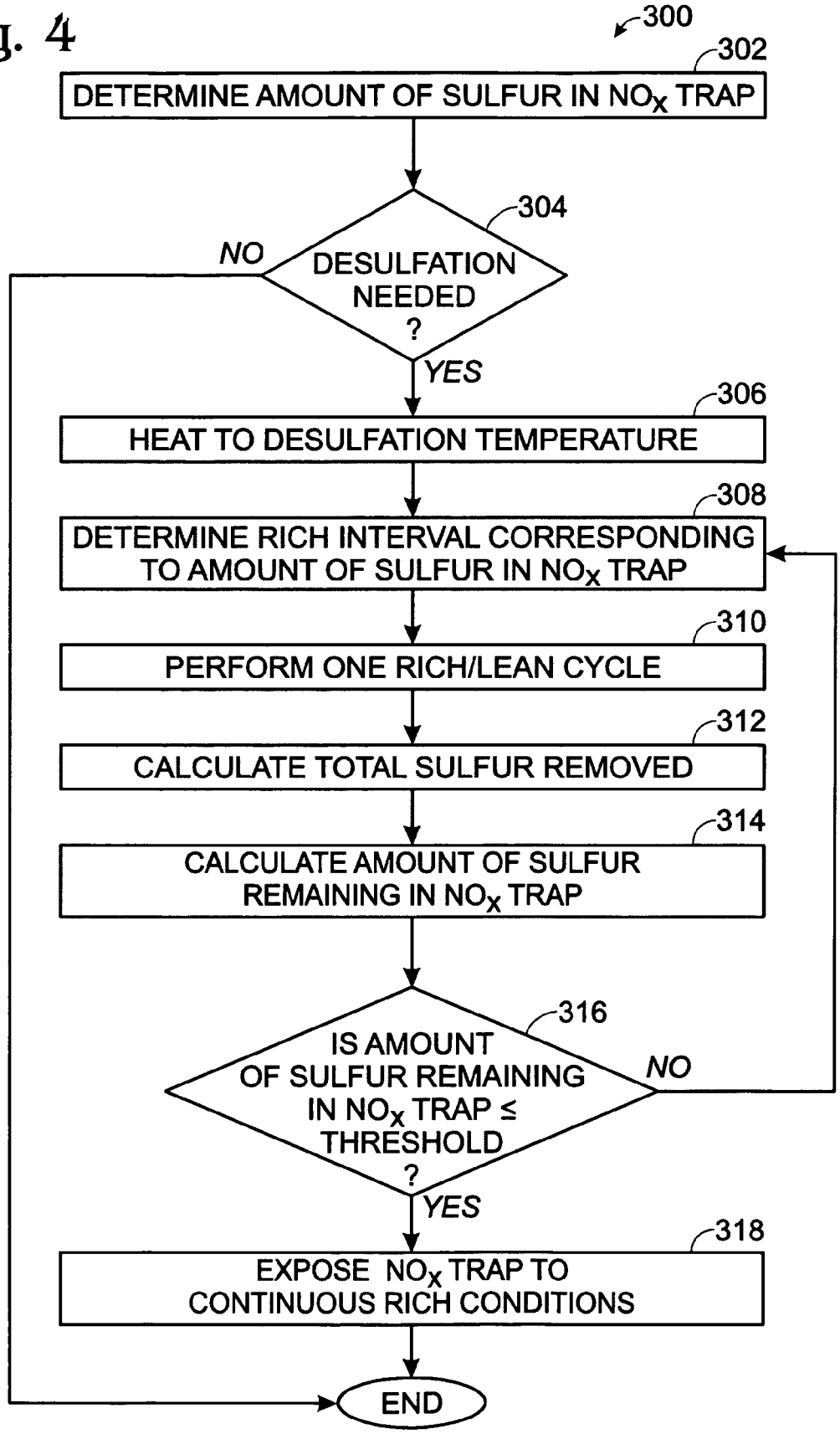
FIG. 4 is a flow diagram of an alternate embodiment of a method for desulfating a $NO_x$ trap.

FIG. 4 illustrates, generally at 300, an alternate embodiment of a method for desulfating $NO_x$ trap 110. Method 300 proceeds in much the same fashion as method 200. For example, method 300 involves determining, at 302, an amount of sulfur stored in $NO_x$ trap 110, and determining, at 304, from this amount whether desulfation is needed. If desulfation is not needed, then method 300 ends, and can be re-started immediately or after any suitable interval.

If, on the other hand, desulfation is needed, then method 300 involves heating (at 306) $NO_x$ trap 110 to desulfation temperature, determining (at 308) a rich interval corresponding to the amount of sulfur stored in the trap, performing (at 310) one rich/lean cycle utilizing the determined rich cycle, and calculating (at 312 and 314, respectively) a total amount of sulfur removed and a total amount of sulfur remaining.

Method 300 next determines, at 316, whether the amount of sulfur remaining in the trap is less than or equal to a predetermined threshold. If the amount of sulfur stored in $NO_x$ trap 110 is not below the predetermined threshold, then method 300 cycles back to step 308. However, if the amount of stored sulfur is less than or equal to the predetermined threshold, then $NO_x$ trap 110 is exposed to a continuous rich period for an interval. This threshold may therefore be referred to as a "continuous-rich" threshold. The continuous-rich threshold may have any suitable value. Suitable values include, but are not limited to, values in the range of approximately 0-0.5 g/liter.

It has been determined that, when an amount of sulfur stored is sufficiently low, $NO_x$ trap 110 can be exposed to a continuous rich exhaust stream without producing undesirable quantities of hydrogen sulfide. Moreover, the use of a continuous rich period at the end of a desulfation process allows desulfation to be finished more rapidly. The magnitude of the continuous rich interval may be determined based upon an amount of sulfur stored when the continuous rich period is commenced, may have a fixed magnitude, or may be determined in any other suitable manner. Furthermore, the continuous rich interval may be an interval of time, a number of engine rotations, or may have any other suitable measure.

EXPERIMENTAL RESULTS

Figure 5:
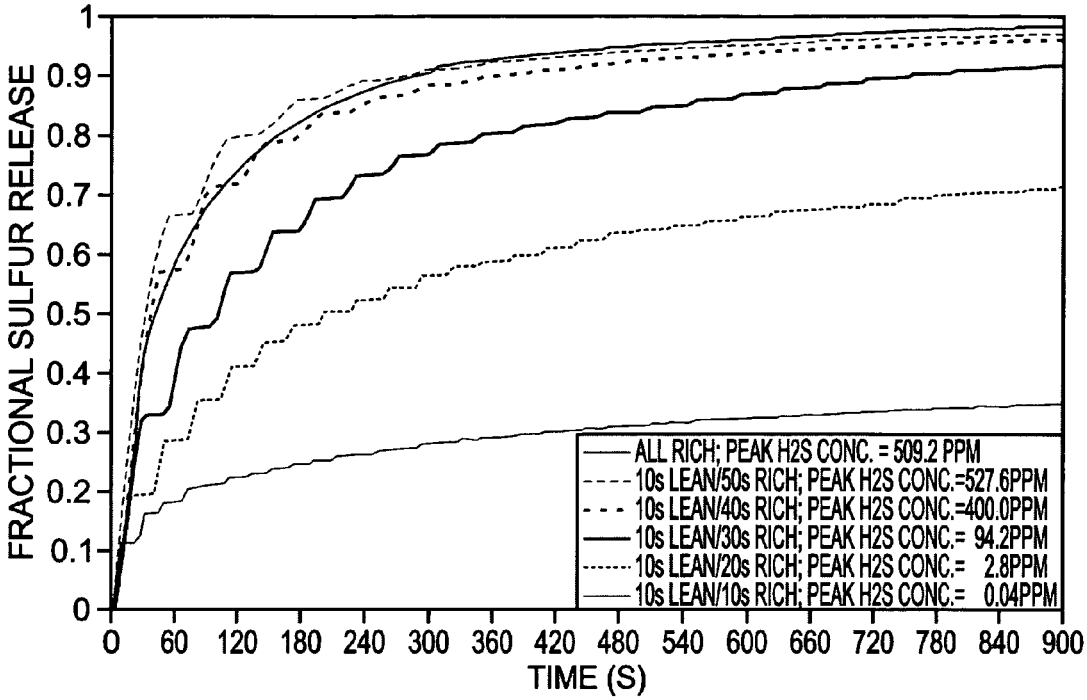
FIG. 5 is graph showing a fraction of sulfur released from a $NO_x$ trap as a function of time for an all-rich desulfation process and a plurality of alternating rich/lean desulfation processes.

FIG. 5 shows the results from an experiment comparing the fractional sulfur release caused by a continuous rich exhaust stream to a plurality of fixed-rich-cycle modulated desulfation schemes. In this experiment, a two-hour aged $NO_x$ trap was sulfur poisoned for one hour with 90 ppm sulfur dioxide and subsequently desulfated at 700° C. for 15 minutes with air/fuel modulations including a constant 10-second lean phase of 5% oxygen and a rich phase of variable time with 1.2% CO, 0.4% H2, and 3.4% makeup $N_2$. The $NO_x$ trap was then desulfated full-time rich at 750° C. to remove any remaining sulfur before the next poisoning experiment. The fractional sulfur release for each run is shown as a line graph, and the peak hydrogen sulfide released in each test run is shown in the legend.

At low rich times (below 20 s rich in FIG. 5), the peak hydrogen sulfide level is kept low. However, sulfur is removed from the trap relatively slowly. At the lowest rich times (ten seconds rich), the trap is never fully purged, even after appreciable desulfation times. Longer rich times (above thirty seconds) purge sulfur much faster, but produce high peak hydrogen sulfide levels (over 500 ppm for the longest rich times). This experiment shows that both continuous-rich and fixed-length modulation desulfation methods fail to provide an adequate desulfation strategy that fully regenerates the trap without producing high levels of hydrogen sulfide.

Figure 6:
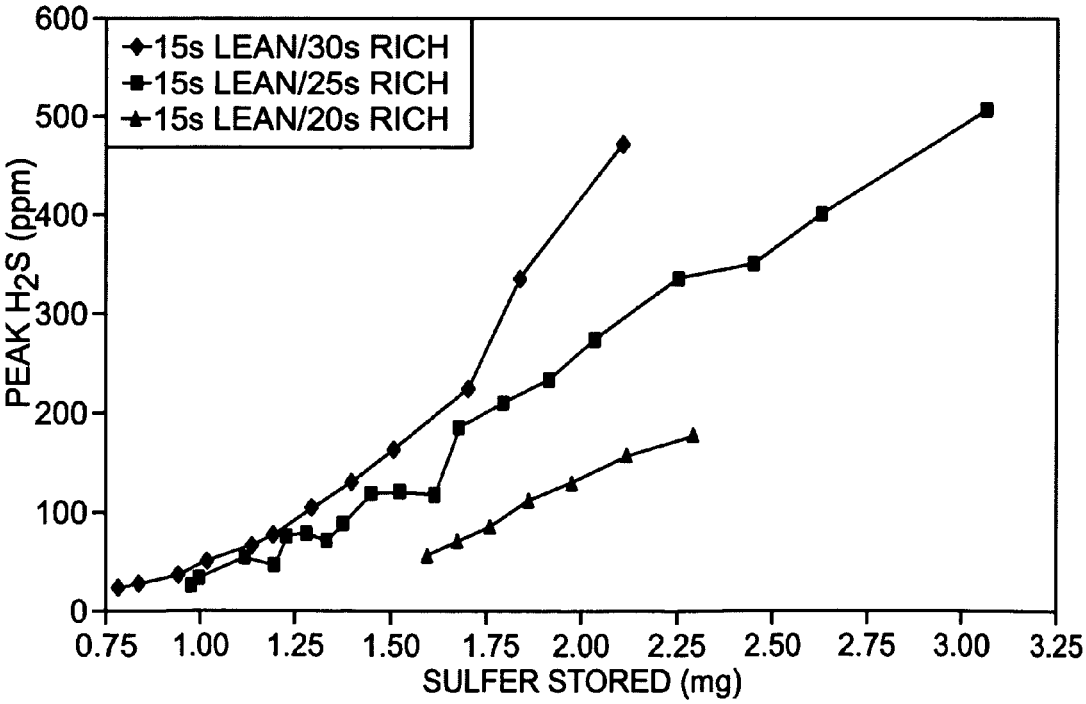
FIG. 6 is a graph showing a peak amount of hydrogen sulfide released from a $NO_x$ trap as a function of an amount of sulfur stored in the trap for a plurality of alternating rich/lean desulfation processes.

FIG. 6 shows a graph illustrating the dependence of the peak hydrogen sulfide produced as a function of the amount of sulfur stored on the $NO_x$ trap. From this figure, it can be seen that, for example, starting a desulfation process at a first rich/lean frequency (for example, 15 second lean/20 second rich), then moving to a second stage with longer rich times (for example, 15 second lean/25 second rich) as the amount of sulfur stored decreases, and then moving to a third stage with yet longer rich times (for example, 15 second lean/30 second rich cycle) with a further decrease in stored sulfur may keep sulfur emissions acceptably low.

Figure 7:
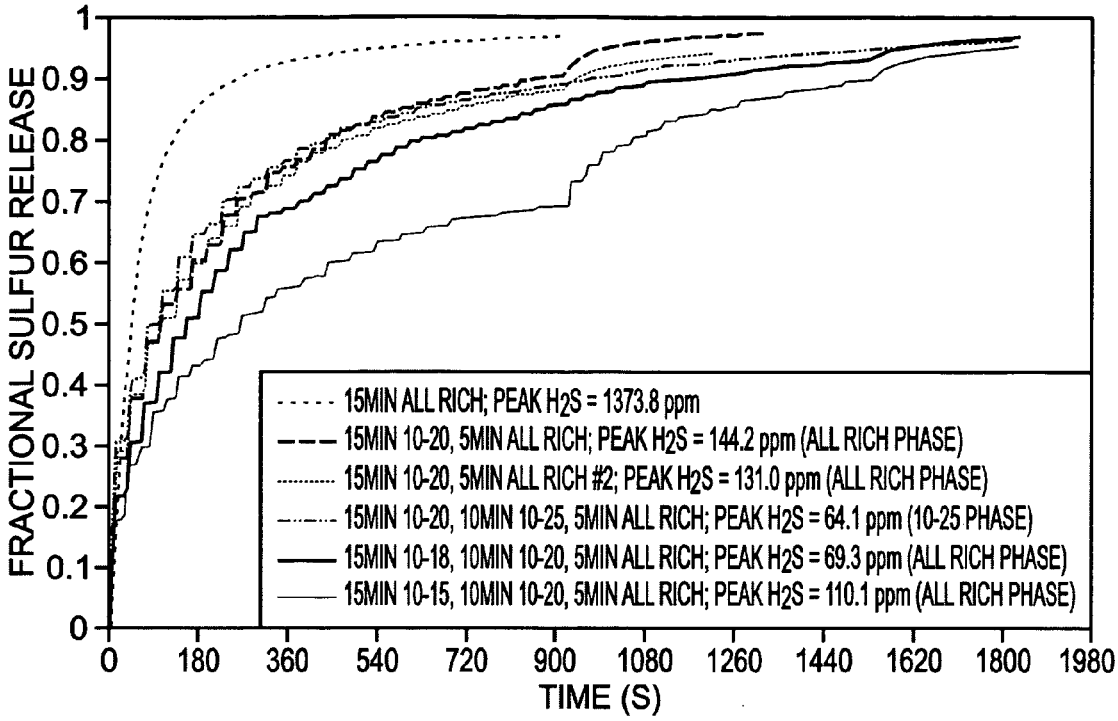
FIG. 7 is a graph showing a fraction of sulfur released as a function of time for a one-stage all-rich desulfation process, a plurality of two-stage desulfation processes, and a plurality of three-stage desulfation processes.

FIG. 7 illustrates the results of two and three-stage desulfation schemes. The two-stage desulfations involved a 15 minute modulated period followed by a 5 minute all-rich period. The three-stage desulfations start with a 15 minute perturbation period of short rich times, continue with a 10 minute perturbation period of longer rich times, and finish with a 5 minute full-rich period. From this figure, it is evident that the use of a three-stage desulfation process can remove sulfur almost as efficiently as an all-rich process or a two-stage process while resulting in much lower peak hydrogen sulfide levels. Two of the three-stage processes produced peak hydrogen sulfide levels in the 60 ppm range, while the two-stage processes produced peak hydrogen sulfide levels in over 100 ppm. It will be noted that the full-rich process produced peak hydrogen sulfide levels of greater than 1000 ppm.

Figure 8:
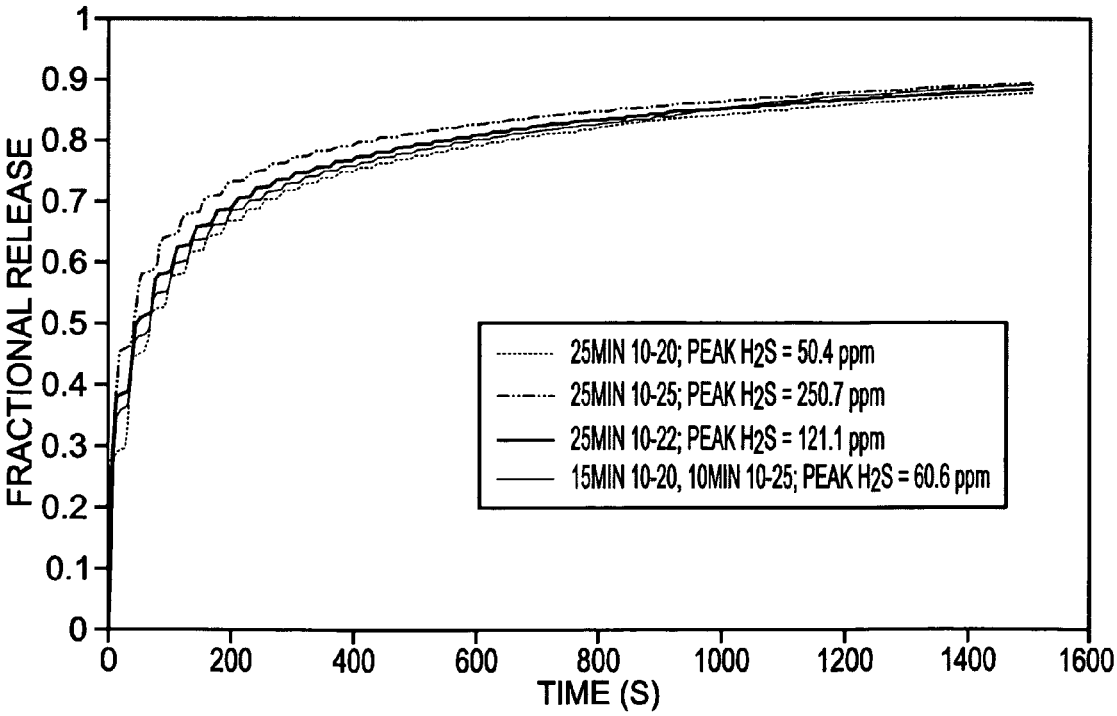
FIG. 8 is a graph showing a fraction of sulfur released as a function of time for a plurality of modulated single-stage desulfation processes and a two-stage desulfation process.

FIG. 8 illustrates a direct comparison between a two-stage and several single-stage desulfation methods. This figure shows the similarity between fractional sulfur release over time for each of the desulfation methods, and also shows the very different peak hydrogen sulfide levels for the methods. As depicted, a 15-minute 10 s lean/20 s rich stage followed by a 10-minute 10 s lean/25 s rich stage showed lower peak hydrogen sulfide levels than a 25-min 10 s/25 s desulfation and better final desulfation performance than a 25-minute 10 s/20 s desulfation. This two-stage desulfation has lower peak hydrogen sulfide levels and better final performance than a 25-minute 10 s/22 s desulfation, which is midway between the other two two-stage desulfation methods.

It will be appreciated that the desulfation processes disclosed herein are exemplary in nature, and that these specific embodiments are not to be considered in a limiting sense, because numerous variations are possible. The subject matter of the present disclosure includes all novel and non-obvious combinations and subcombinations of the various desulfation conditions, modulation frequencies, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the reaction conditions, modulation frequencies, species determination methods, saturation estimate methods, and/or other features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. In an apparatus having a combustion engine and a catalytic $NO_x$ storage and conversion device for treating emissions from the combustion engine, a method of desulfating the catalytic $NO_x$ storage and conversion device, the method comprising:

heating the catalytic $NO_x$ storage and conversion device to a desulfating temperature;

exposing the catalytic $NO_x$ storage and conversion device to alternating rich and lean exhaust streams for a first interval;

exposing the catalytic $NO_x$ storage and conversion device to a continuous rich exhaust stream for a second interval after the first interval; and wherein each rich exhaust stream of the alternating rich and lean exhaust streams has a duration determined based upon an instantaneous amount of sulfur stored in the catalytic $NO_x$ storage and conversion device before the exposure to the rich exhaust stream is initiated.

2. The method of claim 1, wherein each rich exhaust stream of the alternating rich and lean exhaust streams has a longer duration than a prior rich stream.

3. The method of claim 2, further comprising determining an amount of sulfur remaining in the catalytic $NO_x$ storage and conversion device after exposing the catalytic $NO_x$ storage and conversion device to each rich exhaust stream.

4. The method of claim 3, wherein the catalytic $NO_x$ storage and conversion device is exposed to a continuous rich exhaust stream only if an amount of sulfur determined to remain in the catalytic $NO_x$ storage and conversion device is less than or equal to a predetermined threshold.

5. The method of claim 1, wherein the catalytic $NO_x$ storage and conversion device is exposed to the continuous rich exhaust stream for between approximately 0.5 and 15 minutes.

6. The method of claim 1, further comprising ending desulfation after exposing the catalytic $NO_x$ storage and conversion device to the continuous rich exhaust stream.

7. In an apparatus having a combustion engine and a catalytic $NO_x$ storage and conversion device for treating emissions from the combustion engine, a method of desulfating the catalytic $NO_x$ storage and conversion device, the method comprising:

determining an amount of sulfur stored in the catalytic $NO_x$ storage and conversion device;

determining an interval for exposing the catalytic $NO_x$ storage and conversion device to a rich exhaust stream based upon the determined amount of sulfur stored, wherein the interval is longer for lower amounts of sulfur stored and shorter for higher amounts of sulfur stored; and exposing the catalytic $NO_x$ storage and conversion device to the rich exhaust stream for the determined interval;

wherein determining an amount of sulfur stored includes determining an initial amount of sulfur stored, and then determining an instantaneous amount of sulfur stored by subtracting an amount of sulfur removed by a prior exposure to a rich exhaust stream from the initial amount of sulfur stored.

8. The method of claim 7, wherein determining an amount of sulfur stored includes determining whether the amount of sulfur stored is equal to or above a "start-desulfation" threshold, and if the amount of sulfur stored is equal to or above the "start-desulfation" threshold, then determining the interval for exposing the catalytic $NO_x$ storage and conversion device to the rich exhaust stream.

9. The method of claim 8, wherein, if the amount of sulfur stored is not equal to or above the "start-desulfation" threshold, then waiting an interval before again determining the amount of sulfur stored.

10. The method of claim 7, wherein determining an initial amount of sulfur stored includes integrating an amount of sulfur produced by combustion of fuel in the engine during an interval between desulfation processes, and adding the integrated amount of sulfur produced by combustion of fuel in the engine to an amount of sulfur remaining after a prior desulfation process.

11. The method of claim 7, further comprising determining whether the amount of sulfur stored is equal to or less than a "stop-desulfation" threshold, and if the amount of sulfur stored is less than the "stop-desulfation" threshold, then ending desulfation.

12. The method of claim 11, wherein, if the amount of sulfur stored is not equal to or less than the "stop-desulfation" threshold, then determining another interval for which to expose the catalytic $NO_x$ storage and conversion device to the rich exhaust stream.

13. The method of claim 7, further comprising exposing the catalytic $NO_x$ storage and conversion device to a lean exhaust stream after exposing the catalytic $NO_x$ storage and conversion device to a rich exhaust stream, and then repeating the determining an amount of sulfur stored, the determining an interval for exposing the catalytic $NO_x$ storage and conversion device to a rich exhaust stream, and the exposing the catalytic $NO_x$ storage and conversion device for the interval.

14. The method of claim 13, wherein the interval for exposing the catalytic $NO_x$ storage and conversion device to the rich exhaust stream is longer for each successive repetition of the method within a single desulfation process.

15. The method of claim 13, further comprising comparing the amount of sulfur stored to a "continuous-rich" threshold amount of sulfur stored, and if the amount of sulfur stored is less than or equal to the "continuous-rich" threshold, then exposing the catalytic $NO_x$ storage and conversion device to the rich exhaust stream for a continuous interval before ending desulfation.

16. The method of claim 15, wherein the continuous interval has a duration in a range of approximately 0.5-15 minutes.

17. An apparatus, comprising:

a combustion engine;

a conduit for transporting an exhaust stream away from the engine;

a catalytic $NO_x$ storage and conversion region disposed along the conduit; and a controller configured to control a periodic desulfurization of the catalytic $NO_x$ storage and conversion region, wherein controlling the periodic desulfurization includes determining an amount of sulfur stored in the catalytic $NO_x$ storage and conversion device, determining an interval for exposure of the catalytic $NO_x$ storage and conversion device to a rich exhaust stream based upon the determined amount of sulfur stored, wherein the interval is longer and an overall duration for cumulative periodic desulfurization is shorter for lower amounts of sulfur; and wherein the interval is shorter and the overall duration for the cumulative periodic desulfurization is longer for higher amounts of sulfur, and controlling an exposure of the catalytic $NO_x$ storage and conversion device to the rich exhaust stream for the determined interval;

wherein the controller is configured to determine an amount of sulfur stored by determining an initial amount of sulfur stored, and then to determine an instantaneous amount of sulfur stored by subtracting an amount of sulfur removed by a prior exposure to a rich exhaust stream from the initial amount of sulfur stored.

18. The apparatus of claim 17, wherein the apparatus is an automobile.

19. The apparatus of claim 17, wherein the controller is configured to determine whether the amount of sulfur stored is equal to or above a "start-desulfation" threshold, and if the amount of sulfur stored is equal to or above the "start-desulfation" threshold, then to determine the interval for exposing the catalytic $NO_x$ storage and conversion device to the rich exhaust stream.

20. The method of claim 19, wherein, the controller is configured to determine if the amount of sulfur stored is equal to or above the "start-desulfation" threshold, and if the amount of sulfur stored is not equal to or above the "start-desulfation" threshold, then to wait an interval before again determining the amount of sulfur stored.

21. The apparatus of claim 17, wherein the controller is configured to determine an initial amount of sulfur stored by integrating an amount of sulfur produced by combustion of fuel in the engine during an interval between desulfation processes, and adding the integrated amount of sulfur produced by combustion of fuel in the engine to an amount of sulfur remaining after a prior desulfation process.

22. The apparatus of claim 17, wherein the controller is configured to determine whether the amount of sulfur stored is equal to or less than a "stop-desulfation" threshold, and if the amount of sulfur stored is less than the "stop-desulfation" threshold, then to end desulfation.

23. The apparatus of claim 22, wherein, if the controller determines the amount of sulfur stored is not equal to or less than the "stop-desulfation" threshold, then the controller is configured to determine the interval for which to expose the catalytic $NO_x$ storage and conversion device to the rich exhaust stream.

24. The method of claim 17, wherein the controller is configured to repeatedly determine an amount of sulfur stored, to determine an interval for exposing the catalytic $NO_x$ storage and conversion device to a rich exhaust stream, to control an exposure of the catalytic $NO_x$ storage and conversion device to the rich exhaust stream for the interval, and then to control an exposure of the catalytic $NO_x$ storage and conversion device to a lean exhaust stream.

25. The apparatus of claim 24, wherein the interval for exposing the catalytic $NO_x$ storage and conversion device to the rich exhaust stream is longer for each successive repetition of the method within a single desulfation process.

26. The apparatus of claim 24, wherein the controller is further configured to compare the amount of sulfur stored to a "continuous-rich" threshold amount of sulfur stored, and if the amount of sulfur stored is less than or equal to the "continuous-rich" threshold, then to control an exposure of the catalytic $NO_x$ storage and conversion device to the rich exhaust stream for a continuous interval before ending desulfation.

* * * * *